US010513381B2

(12) United States Patent
Nielsen et al.

(10) Patent No.: US 10,513,381 B2
(45) **Date of Patent: *Dec. 24, 2019**

(54) CARTON WITH HANDLE

(71) Applicant: Graphic Packaging International, Inc., Atlanta, GA (US)

(72) Inventors: John Carsten Nielsen, St Clair (AU); Renae Kylie Yeomans, Erskineville (AU)

(73) Assignee: Graphic Packaging International, LLC, Atlanta, GA (US)

( * ) Notice: Subject to any disclaimer, the term of this patent is extended or adjusted under 35 U.S.C. 154(b) by 292 days.

This patent is subject to a terminal disclaimer.

(21) Appl. No.: 15/430,666

(22) Filed: Feb. 13, 2017

(65) Prior Publication Data

US 2017/0233131 A1 Aug. 17, 2017

Related U.S. Application Data

(60) Provisional application No. 62/294,552, filed on Feb. 12, 2016.

(51) Int. Cl.

| | |
|---|---|
| ***B65D 71/36*** | (2006.01) |
| *B31B 100/00* | (2017.01) |
| *B31B 50/26* | (2017.01) |

(52) U.S. Cl.

CPC ..... *B65D 71/36* (2013.01); *B31B 50/26* (2017.08); *B31B 2100/0026* (2017.08);

(Continued)

(58) Field of Classification Search

CPC ..... B31B 2100/0026; B31B 2241/001; B31B 50/14; B31B 50/26; B31B 50/86; B65D 5/02; B65D 5/0227; B65D 5/18; B65D 5/32; B65D 5/42; B65D 5/4266; B65D 5/46; B65D 5/4608; B65D 5/468;

(Continued)

(56) References Cited

U.S. PATENT DOCUMENTS

| | | |
|---|---|---|
| 1,253,193 A | 1/1918 | Hill |
| 2,375,631 A | 5/1945 | DeVillard |

(Continued)

FOREIGN PATENT DOCUMENTS

| | | |
|---|---|---|
| BE | 671762 | 3/1966 |
| CA | 8 777 92 | 8/1971 |

(Continued)

OTHER PUBLICATIONS

International Search Report and Written Opinion for PCT/US2017/017607 dated May 22, 2017.

(Continued)

*Primary Examiner* — Bryon P Gehman

(74) *Attorney, Agent, or Firm* — Womble Bond Dickinson (US) LLP

(57) ABSTRACT

A carton for carrying a plurality of articles includes a plurality of panels for at least partially forming an interior of the carton. The plurality of panels includes a top panel, a bottom panel, and at least one side panel, and the plurality of panels include a material having a grain direction. At least one handle is formed in the top panel and defines a major axis that is substantially parallel to the grain direction.

39 Claims, 6 Drawing Sheets

(52) U.S. Cl.
CPC ..... *B31B 2241/001* (2013.01); *B65D 2571/0045* (2013.01); *B65D 2571/0058* (2013.01); *B65D 2571/00141* (2013.01); *B65D 2571/00728* (2013.01)

(58) Field of Classification Search
CPC . B65D 5/54; B65D 5/542; B65D 5/72; B65D 71/00; B65D 71/06; B65D 71/28; B65D 71/34; B65D 71/36; B65D 2571/00141; B65D 2571/0038; B65D 2571/0045; B65D 2571/00543; B65D 2571/00574; B65D 2571/0066; B65D 2571/00728
USPC ..... 206/427, 428–435; 229/117.13, 117.14
See application file for complete search history.

(56) References Cited

U.S. PATENT DOCUMENTS 2,383,183 A 8/1945 Fischer
2,594,376 A 4/1952 Arneson
2,605,035 A 7/1952 Williamson
2,702,144 A 2/1955 Forrer
2,718,301 A 9/1955 Palmer
2,785,847 A 3/1957 Forrer
2,797,856 A 7/1957 Jaeschke
2,810,506 A 10/1957 Kessler
2,811,250 A 10/1957 Arneson
2,849,111 A 8/1958 Fielding
2,868,433 A 1/1959 Anderson, Jr.
2,872,036 A 2/1959 Forrer
2,874,869 A 2/1959 Hennessey
2,922,561 A 1/1960 Currivan
2,928,541 A 3/1960 Fielding
2,955,739 A 10/1960 Collura
3,112,856 A 12/1963 MacIntosh et al.
3,127,720 A 4/1964 Gentry et al.
3,178,242 A 4/1965 Ellis
3,204,815 A 9/1965 Weiss
3,257,066 A 6/1966 Williams
3,269,531 A 8/1966 Weiss
3,300,115 A 1/1967 Schauer
3,306,519 A 2/1967 Wood
3,309,005 A 3/1967 Pilger
3,334,767 A 8/1967 Cornelius et al.
3,339,723 A 9/1967 Wood
3,353,709 A 11/1967 Lawrence
3,355,012 A 11/1967 Weiss
3,356,279 A 12/1967 Root
3,371,846 A 3/1968 Detzel
3,373,867 A 3/1968 Wood
3,381,881 A 5/1968 Granz et al.
3,554,402 A 1/1971 Lock
3,593,849 A 7/1971 Helms
3,635,452 A 1/1972 Helms
3,669,342 A 6/1972 Funkhouse
3,692,232 A 9/1972 Helms
3,747,835 A 7/1973 Graser
3,767,042 A 10/1973 Ganz
3,828,926 A 8/1974 Rossi
3,886,901 A 6/1975 Zeitler
3,904,036 A 9/1975 Forrer
3,933,303 A 1/1976 Kirby, Jr.
3,963,121 A 6/1976 Kipp
3,994,432 A 11/1976 Kirby, Jr.
4,010,593 A 3/1977 Graham
4,029,204 A 6/1977 Manizza
4,034,852 A 7/1977 Forrer
4,036,423 A 7/1977 Gordon
4,096,985 A 6/1978 Wood
4,101,069 A 7/1978 Wood
4,111,306 A 9/1978 Roccaforte
4,202,446 A 5/1980 Sutherland
4,216,861 A 8/1980 Oliff
4,222,485 A 9/1980 Focke
4,295,562 A 10/1981 Wood
4,314,634 A 2/1982 Stone
4,318,474 A 3/1982 Hasegawa
4,327,829 A 5/1982 Hughes
4,328,893 A 5/1982 Oliff
4,328,923 A 5/1982 Graser
4,329,923 A 5/1982 Iida
4,331,289 A 5/1982 Killy
4,339,070 A 7/1982 Davies
4,364,509 A 12/1982 Holley, Jr.
4,375,258 A 3/1983 Crayne et al.
4,378,905 A 4/1983 Roccaforte
4,382,505 A 5/1983 Sutherland
4,394,903 A 7/1983 Bakx
4,405,078 A 9/1983 Dutcher
4,424,901 A 1/1984 Lanier
4,440,340 A 4/1984 Bakx
4,463,852 A * 8/1984 Stone ..... B65D 71/0014 206/141
4,470,503 A 9/1984 Stone
4,478,334 A 10/1984 Graser
4,498,581 A * 2/1985 Dutcher ..... B65D 71/36 206/427
4,498,619 A 2/1985 Roccaforte
4,508,258 A 4/1985 Graser
4,533,047 A 8/1985 Calvert
4,538,759 A 9/1985 Dutcher
4,545,485 A 10/1985 Oliff
4,546,914 A 10/1985 Roccaforte
4,558,816 A 12/1985 Wood
4,566,593 A 1/1986 Muller
4,577,799 A 3/1986 Oliff
4,582,199 A 4/1986 Schuster
4,588,084 A 5/1986 Holley
4,637,515 A 1/1987 Wilson et al.
4,653,686 A 3/1987 Wood
4,681,217 A 7/1987 Hernandez
4,681,252 A 7/1987 Doerr
4,684,059 A 8/1987 Rusnock
4,706,876 A 11/1987 Wilson
4,728,025 A 3/1988 Oliff
4,728,026 A 3/1988 Schuster
4,747,487 A 5/1988 Wood
4,747,534 A 5/1988 Marie
4,784,266 A 11/1988 Chaussadas
4,784,316 A 11/1988 Crouch
4,785,991 A 11/1988 Schuster
4,802,583 A 2/1989 Calvert
4,804,089 A 2/1989 Wilson
4,811,894 A 3/1989 Schuster
4,830,267 A 5/1989 Wilson
4,838,479 A 6/1989 Wood
4,875,585 A 10/1989 Kadleck
4,875,586 A 10/1989 Chaussadas
RE33,110 E 11/1989 Wood
4,901,849 A 2/1990 Wilson
4,919,266 A 4/1990 McIntosh, Jr.
4,958,734 A 9/1990 Wood
4,966,324 A 10/1990 Steel
4,972,991 A 11/1990 Schuster
4,974,771 A 12/1990 Lavery
4,981,253 A 1/1991 Quaintance
5,000,313 A 3/1991 Oliff
5,002,186 A 3/1991 Cooper
5,020,337 A 6/1991 Krieg
5,042,660 A 8/1991 Carver
5,060,792 A 10/1991 Oliff
5,072,876 A 12/1991 Wilson
5,094,359 A 3/1992 DeMars
5,106,014 A 4/1992 Miller
5,108,030 A 4/1992 Schuster
5,119,985 A 6/1992 Dawson
5,131,588 A 7/1992 Oliff
5,180,100 A 1/1993 Shimizu
5,195,676 A 3/1993 LeBras
5,197,598 A 3/1993 Stout et al.
5,221,041 A 6/1993 Stout
5,222,658 A 6/1993 DeMaio
5,234,102 A 8/1993 Schuster
5,246,112 A 9/1993 Stout

(56) References Cited

U.S. PATENT DOCUMENTS

| | | | | |
|---|---|---|---|---|
| 5,284,294 | A | 2/1994 | Floyd | |
| 5,292,058 | A | 3/1994 | Zoss | |
| 5,292,059 | A | 3/1994 | Oliff | |
| 5,297,673 | A | 3/1994 | Sutherland | |
| 5,297,725 | A | 3/1994 | Sutherland | |
| 5,303,863 | A | 4/1994 | Arasim | |
| 5,307,932 | A | 5/1994 | Stout | |
| 5,307,986 | A | 5/1994 | Schuster | |
| 5,320,277 | A | 6/1994 | Stout | |
| 5,333,734 | A | 8/1994 | Stout | |
| D350,480 | S | 9/1994 | Sutherland | |
| 5,351,878 | A | 10/1994 | Cooper | |
| 5,379,944 | A | 1/1995 | Stout | |
| 5,381,891 | A | 1/1995 | Harris | |
| 5,385,234 | A | 1/1995 | Stout | |
| 5,395,044 | A | 3/1995 | Stout | |
| 5,421,458 | A | 6/1995 | Campbell | |
| 5,427,241 | A | 6/1995 | Sutherland | |
| 5,458,234 | A | 10/1995 | Harris | |
| 5,472,090 | A | 12/1995 | Sutherland | |
| 5,472,138 | A | 12/1995 | Ingram | |
| 5,480,091 | A | 1/1996 | Stout | |
| 5,482,203 | A | 1/1996 | Stout | |
| 5,485,915 | A | 1/1996 | Harris | |
| 5,495,727 | A | 3/1996 | Strong | |
| 5,505,372 | A | 4/1996 | Edson | |
| 5,524,756 | A | 6/1996 | Sutherland | |
| 5,542,536 | A | 8/1996 | Sutherland | |
| 5,549,197 | A | 8/1996 | Sutherland | |
| 5,551,556 | A | 9/1996 | Sutherland | |
| 5,558,212 | A | 9/1996 | Sutherland | |
| 5,558,213 | A | 9/1996 | Sutherland | |
| 5,582,343 | A | 12/1996 | Dalvey | |
| 5,593,027 | A | 1/1997 | Sutherland | |
| 5,595,291 | A | 1/1997 | Negelen | |
| 5,595,292 | A | 1/1997 | Bates | |
| 5,597,071 | A | 1/1997 | Sutherland | |
| 5,609,251 | A | 3/1997 | Harris | |
| 5,639,017 | A | 6/1997 | Fogle | |
| 5,647,483 | A | 7/1997 | Harris | |
| 5,664,401 | A | 9/1997 | Portrait | |
| 5,669,500 | A | 9/1997 | Sutherland | |
| 5,682,995 | A | 11/1997 | Sutherland | |
| 5,692,614 | A | 12/1997 | Harris | |
| 5,699,957 | A | 12/1997 | Blin | |
| 5,704,470 | A | 1/1998 | Sutherland | |
| 5,738,273 | A | 4/1998 | Auclair | |
| 5,778,630 | A | 7/1998 | Portrait | |
| 5,794,778 | A | 8/1998 | Harris | |
| 5,796,778 | A | 8/1998 | Kurker | |
| 5,819,920 | A | 10/1998 | Sutherland | |
| 5,826,782 | A | 10/1998 | Stout | |
| 5,826,783 | A | 10/1998 | Stout | |
| 5,853,088 | A | 12/1998 | Saulas | |
| 5,855,318 | A | 1/1999 | Baxter | |
| 5,873,515 | A | 2/1999 | Dunn et al. | |
| 5,878,946 | A | 3/1999 | Frerot | |
| 5,906,313 | A | 5/1999 | Oliff | |
| 5,915,546 | A | 6/1999 | Harrelson | |
| 5,931,300 | A | 8/1999 | Sutherland | |
| 5,937,620 | A | 8/1999 | Chalendar | |
| 5,941,453 | A | 8/1999 | Oliff | |
| 5,947,367 | A | 9/1999 | Miller | |
| 5,975,286 | A | 11/1999 | Oliff | |
| 5,992,733 | A | 11/1999 | Gomes | |
| 5,996,883 | A | 12/1999 | Bates | |
| 6,019,220 | A | 2/2000 | Sutherland | |
| 6,019,276 | A | 2/2000 | Auclair | |
| 6,021,898 | A | 2/2000 | Sutherland | |
| 6,021,899 | A | 2/2000 | Sutherland | |
| 6,065,590 | A | 5/2000 | Spivey | |
| 6,105,853 | A | 8/2000 | Lamare | |
| 6,105,854 | A | 8/2000 | Spivey | |
| 6,109,438 | A | 8/2000 | Sutherland | |
| 6,126,066 | A | 10/2000 | Peterson | |
| 6,129,266 | A | 10/2000 | Oliff | |
| 6,131,803 | A | 10/2000 | Oliff | |
| 6,155,480 | A | 12/2000 | Botsford | |
| 6,158,586 | A | 12/2000 | Muller | |
| 6,164,526 | A | 12/2000 | Dalvey | |
| 6,170,741 | B1 | 1/2001 | Skolik | |
| 6,227,367 | B1 | 5/2001 | Harrelson | |
| 6,237,839 | B1 | 5/2001 | Brown | |
| 6,250,542 | B1 | 6/2001 | Negelen | |
| 6,260,755 | B1 | 7/2001 | Bates | |
| 6,273,330 | B1 | 8/2001 | Oliff | |
| 6,289,651 | B1 | 9/2001 | LeBras | |
| 6,302,320 | B1 | 10/2001 | Stout | |
| 6,315,123 | B1 | 11/2001 | Ikeda | |
| 6,425,520 | B1 | 7/2002 | Peterson | |
| 6,484,903 | B2 | 11/2002 | Spivey | |
| 6,523,739 | B2 | 2/2003 | Heeley et al. | |
| 6,536,656 | B2 | 3/2003 | Auclair | |
| 6,550,616 | B2 | 4/2003 | LeBras | |
| 6,631,803 | B2 | 10/2003 | Rhodes et al. | |
| 6,695,137 | B2 | 2/2004 | Jones | |
| 6,758,337 | B2 | 7/2004 | Chargueraud | |
| 6,766,940 | B2 | 7/2004 | Negelen | |
| 6,811,525 | B2 | 11/2004 | Culpepper | |
| 6,848,573 | B2 | 2/2005 | Gould | |
| 6,866,185 | B2 | 3/2005 | Harrelson | |
| 6,896,130 | B2 | 5/2005 | Theelen | |
| 6,905,066 | B2 | 6/2005 | Holley, Jr. | |
| 6,926,193 | B2 | 8/2005 | Smalley | |
| 6,942,140 | B2 | 9/2005 | Merzeau | |
| 6,948,651 | B2 | 9/2005 | Ikeda | |
| 6,968,992 | B2 | 11/2005 | Schuster | |
| 6,981,631 | B2 | 1/2006 | Fogle | |
| 6,988,617 | B2 | 1/2006 | Gomes | |
| 7,007,800 | B2 | 3/2006 | LeBras | |
| 7,007,836 | B2 | 3/2006 | Smalley | |
| 7,159,759 | B2 | 1/2007 | Sutherland | |
| 7,273,161 | B2 | 9/2007 | Fogle | |
| 7,427,010 | B2 | 9/2008 | Sutherland | |
| 7,448,492 | B2 | 11/2008 | Sutherland | |
| 7,472,791 | B2 | 1/2009 | Spivey, Sr. | |
| 7,743,968 | B2 | 6/2010 | Theelen | |
| 7,748,603 | B2 | 7/2010 | Fogle | |
| 7,757,933 | B2 | 7/2010 | Dunn | |
| 7,762,397 | B2 | 7/2010 | Coltri-Johnson | |
| 7,793,779 | B2 | 9/2010 | Spivey, Sr. | |
| 7,806,314 | B2 | 10/2010 | Sutherland | |
| 8,191,761 | B2 | 6/2012 | Brand | |
| 8,348,142 | B2 | 1/2013 | Smalley | |
| 8,479,973 | B2 * | 7/2013 | Brand | B65D 71/36 229/117.13 |
| 8,596,518 | B2 * | 12/2013 | Babcock | B65D 5/443 229/117.16 |
| 8,978,963 | B2 | 3/2015 | Kastanek | |
| 8,985,433 | B2 * | 3/2015 | Sutherland | B65D 71/36 206/141 |
| 9,199,774 | B2 | 12/2015 | Smalley et al. | |
| 9,376,230 | B2 | 6/2016 | Kastanek et al. | |
| 9,376,244 | B2 | 6/2016 | Kastanek et al. | |
| 9,604,767 | B2 * | 3/2017 | Ramsuer | B65D 71/36 |
| 9,656,789 | B2 | 5/2017 | Requena | |
| 10,059,485 | B2 * | 8/2018 | Spivey, Sr. | B31B 50/81 |
| 2003/0000182 | A1 | 1/2003 | Portrait et al. | |
| 2003/0080180 | A1 | 5/2003 | Holley, Jr. et al. | |
| 2003/0132130 | A1 | 7/2003 | Bras | |
| 2003/0213263 | A1 | 11/2003 | Woog | |
| 2004/0011674 | A1 | 1/2004 | Theelen | |
| 2004/0074854 | A1 | 4/2004 | Lin | |
| 2004/0089671 | A1 | 5/2004 | Miller | |
| 2004/0188277 | A1 | 9/2004 | Auclair | |
| 2004/0188301 | A1 | 9/2004 | Gomes | |
| 2004/0238611 | A1 | 12/2004 | Sutherland | |
| 2004/0243277 | A1 | 12/2004 | Bonnain et al. | |
| 2004/0254666 | A1 | 12/2004 | Bonnain et al. | |
| 2005/0001020 | A1 | 1/2005 | Garner | |
| 2005/0056658 | A1 | 3/2005 | Spivey | |
| 2005/0167478 | A1 | 8/2005 | Holley | |
| 2005/0178791 | A1 | 8/2005 | Miller | |
| 2005/0194430 | A1 | 9/2005 | Auclair et al. | |

(56) References Cited

U.S. PATENT DOCUMENTS

| | | | |
|---|---|---|---|
| 2006/0169755 | A1 | 8/2006 | Spivey |
| 2006/0191811 | A1 | 8/2006 | Fogle et al. |
| 2006/0255108 | A1 | 11/2006 | Shmagin |
| 2006/0273143 | A1 | 12/2006 | Finch |
| 2007/0017962 | A1 | 1/2007 | Russ |
| 2007/0029371 | A1 | 2/2007 | Theelen |
| 2007/0039846 | A1 | 2/2007 | Spivey |
| 2007/0051781 | A1 | 3/2007 | Holley, Jr. |
| 2007/0090175 | A1 | 4/2007 | Schemmel |
| 2007/0108261 | A1 | 5/2007 | Schuster |
| 2007/0164091 | A1 | 7/2007 | Fogle |
| 2007/0181658 | A1 | 8/2007 | Sutherland |
| 2007/0205255 | A1 | 9/2007 | Dunn |
| 2007/0284424 | A1 | 12/2007 | Holley |
| 2007/0295789 | A1 | 12/2007 | Ho Fung |
| 2008/0067223 | A1 | 3/2008 | Jego |
| 2008/0073420 | A1 | 3/2008 | Walling et al. |
| 2009/0236408 | A1 | 9/2009 | Spivey |
| 2010/0044420 | A1 | 2/2010 | Brand |
| 2010/0213249 | A1 | 8/2010 | Requena |
| 2011/0030321 | A1 | 2/2011 | Brand |
| 2011/0036902 | A1 | 2/2011 | Smalley |
| 2012/0321754 | A1 | 12/2012 | Block |
| 2013/0043299 | A1 | 2/2013 | Sutherland |
| 2015/0151889 | A1 | 6/2015 | Kastanek et al. |
| 2016/0009442 | A1 | 1/2016 | Block et al. |

FOREIGN PATENT DOCUMENTS

| | | |
|---|---|---|
| CA | 1 243 987 | 11/1988 |
| CA | 2 160 145 | 9/1995 |
| DE | 85 14 718.4 | 6/1985 |
| DE | 91 04 905.9 | 6/1991 |
| DE | 92 03 858.1 | 5/1992 |
| DE | 296 07 374 | 4/1996 |
| DE | 201 12 228 | 11/2002 |
| DE | 10 2004 006 899 A1 | 11/2004 |
| DE | 20 200 4018 649 | 4/2005 |
| EP | 0 473 266 | 3/1992 |
| EP | 0 509 749 | 10/1992 |
| EP | 0 459 658 | 12/1992 |
| EP | 0 520 411 | 12/1992 |
| EP | 1 612 157 | 1/2006 |
| EP | 2 149 506 | 2/2010 |
| FR | 1 438 035 | 1/1965 |
| FR | 2 698 074 | 5/1994 |
| GB | 1 101 345 | 1/1968 |
| GB | 2 202 825 | 10/1988 |
| GB | 2 209 515 | 5/1989 |
| JP | 5-112373 | 5/1993 |
| JP | 7-11566 | 2/1995 |
| JP | H08-2551 | 1/1996 |
| JP | 10-338266 | 12/1998 |
| JP | 2003-200967 | 7/2003 |
| JP | 2004-533378 | 11/2004 |
| JP | 2007-055630 | 3/2007 |
| JP | 2008-013200 | 1/2008 |
| WO | WO 96/27538 | 9/1996 |
| WO | WO 97/27124 | 7/1997 |
| WO | WO 98/09871 | 3/1998 |
| WO | WO 99/28207 | 6/1999 |
| WO | WO 00/78618 | 12/2000 |
| WO | WO 01/66434 | 9/2001 |
| WO | WO 02/102208 | 12/2002 |
| WO | WO 03/004377 | 1/2003 |
| WO | WO 03/008292 | 1/2003 |
| WO | WO 03/037742 | 5/2003 |
| WO | WO 2005/042370 | 5/2005 |
| WO | WO 2005/080218 | 9/2005 |
| WO | WO 2005/123532 | 12/2005 |
| WO | WO 2007/089282 | 8/2007 |
| WO | WO 2009/117562 | 9/2009 |
| WO | WO 2011/022378 | 2/2011 |

OTHER PUBLICATIONS

Supplementary European Search Report for EP 17 75 0941 dated Sep. 23, 2019.

* cited by examiner

CARTON WITH HANDLE

CROSS-REFERENCE TO RELATED APPLICATION

The present application claims the benefit of U.S. Provisional Patent Application No. 62/294,552, filed on Feb. 12, 2016.

INCORPORATION BY REFERENCE

The disclosure of U.S. Provisional Patent Application No. 62/294,552, filed on Feb. 12, 2016, is hereby incorporated by reference for all purposes as if presented herein it its entirety.

BACKGROUND OF THE DISCLOSURE

The present disclosure generally relates to cartons or carriers for holding beverage containers or other types of articles. More specifically, the present disclosure relates to cartons that include handle features for carrying the carton.

SUMMARY OF THE DISCLOSURE

In general, one aspect of the disclosure is directed to a carton made from a material for carrying a plurality of articles. The carton includes a plurality of panels that extend at least partially around an interior of the carton. The plurality of panels includes a top panel, a first side panel, a second side panel, and bottom panel. A plurality of end flaps is foldably connected to respective panels of the plurality of panels for closing at least one end of the carton. The carton includes handle features extending in at least the top panel. The handle features include at least one handle that is oriented parallel to the grain direction of the material such that the strength of the carton is increased.

According to one aspect of the disclosure, a carton for carrying a plurality of articles comprises a plurality of panels for at least partially forming an interior of the carton. The plurality of panels comprises a top panel, a bottom panel, and at least one side panel, and the plurality of panels comprise a material having a grain direction. At least one handle is formed in the top panel and defines a major axis that is substantially parallel to the grain direction.

According to another aspect of the disclosure, a blank for forming carton for carrying a plurality of articles comprises a plurality of panels for at least partially forming an interior of the carton formed from the blank. The plurality of panels comprises a top panel, a bottom panel, and at least one side panel, and the plurality of panels comprise a material having a grain direction. At least one handle is formed in the top panel and defines a major axis that is substantially parallel to the grain direction.

According to another aspect of the disclosure, a method of forming a carton for carrying a plurality of articles comprises obtaining a blank comprising a plurality of panels. The plurality of panels comprises a top panel, a bottom panel, and at least one side panel, and the plurality of panels comprise a material having a grain direction. At least one handle is formed in the top panel and defines a major axis that is substantially parallel to the grain direction. The method also comprises folding the plurality of panels to at least partially form an interior of the carton.

In another aspect, the present disclosure is generally directed to a blank for forming a carton for carrying a plurality of articles.

In another aspect, the present disclosure is generally directed to a method of forming a carton for carrying a plurality of articles.

Other aspects, features, and details of the present disclosure can be more completely understood by reference to the following detailed description of exemplary embodiments taken in conjunction with the drawings.

BRIEF DESCRIPTION OF THE DRAWINGS

Those skilled in the art will appreciate the above stated advantages and other advantages and benefits of various additional embodiments reading the following detailed description of the embodiments with reference to the below-listed drawing figures. Further, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to cartons, packages, constructs, sleeves, carriers, or the like, for holding and displaying articles, for example, containers such as jars, bottles, cans, etc. The containers can be used for packaging food and beverage products, for example. The containers can be made from materials suitable in composition for packaging the particular food or beverage item, and the materials include, but are not limited to, glass; plastics such as PET, LDPE, LLDPE, HDPE, PP, PS, PVC, EVOH, and Nylon; and the like; aluminum and/or other metals; or any combination thereof.

Cartons according to the present invention can accommodate articles of any shape. For the purpose of illustration and not for the purpose of limiting the scope of the invention, the following detailed description describes beverage containers as disposed within the carton embodiments. In this specification, the terms "inner," "interior," "outer," "exterior," "lower," "bottom," "upper," and "top" indicate orientations determined in relation to fully erected and upright cartons.

Figure 1:
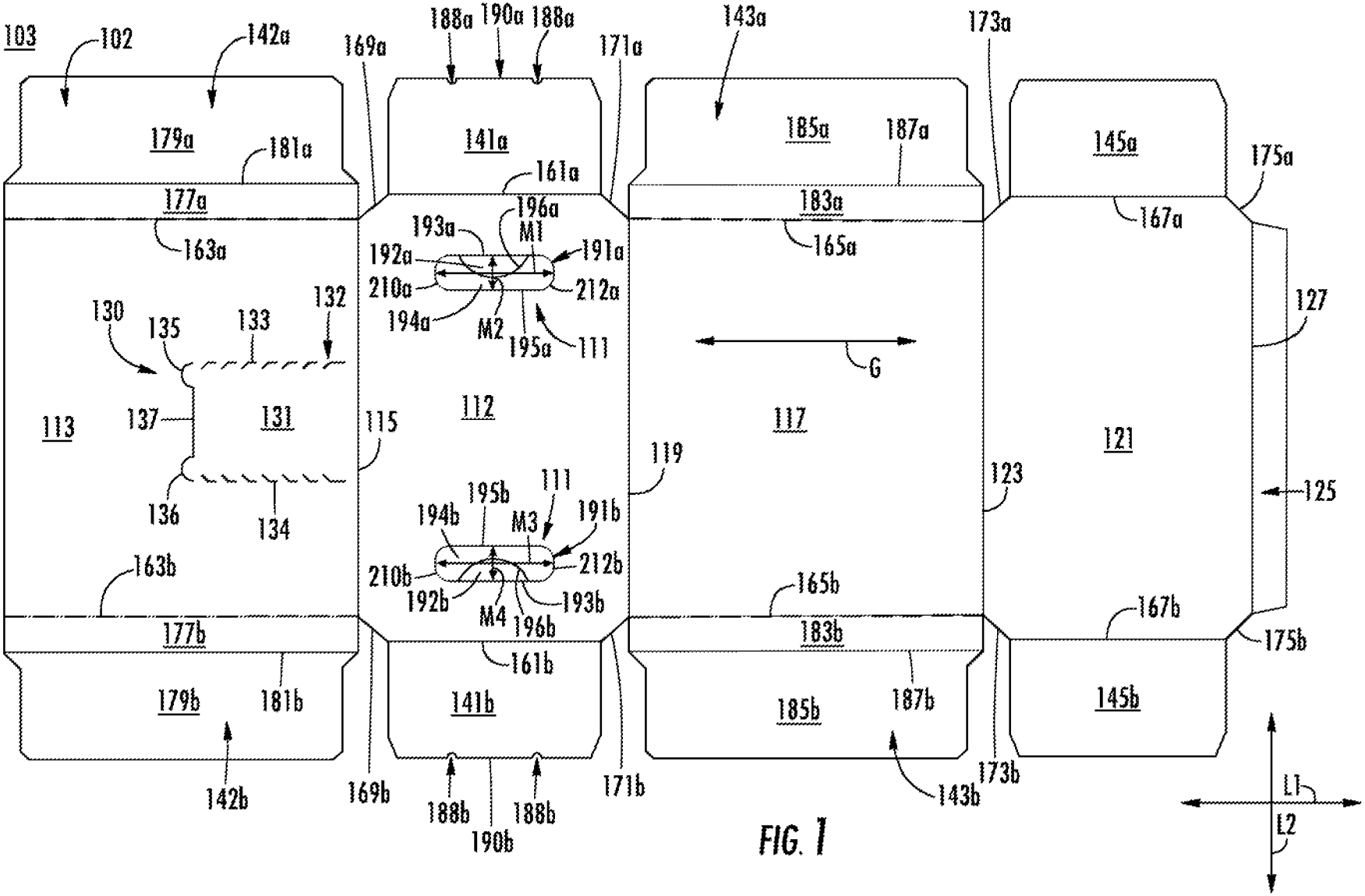
FIG. 1 is a plan view of an exterior side of a blank according to one exemplary embodiment of the disclosure.

FIG. 1 is a plan view of an exterior surface 102 of a blank 103, used to form a carton 105 (FIG. 4), according to one exemplary embodiment of the disclosure. The carton 105 can be used to house a plurality of articles such as containers C (not shown). The carton 105 has handle features, generally indicated at 111, for grasping and carrying the carton 105. In one embodiment, the blank 103 is sized to form a carton 105 that contains thirty containers in two layers with each layer having fifteen containers (e.g., a 3×5×2 arrangement). It will be understood that the blank 103 and/or carton 105 may be sized and shaped to hold containers of a different or same quantity in a single layer or more than two layers and/or in different row/column arrangements (e.g., 3×6, 2×3, 2×4, 2×5, 2×6, 2×2×3, 3×6×3, 3×4×2, etc.). In one embodiment, the containers are cans, but other types of containers (e.g., bottles) can be used in the carton 105. In the illustrated embodiment of the disclosure, the handle features 111 comprise a first and a second handle 191*a*, 191*b* adjacent a respective end 149, 159 of the carton 105 and the handles 191*a*, 191*b* can be oriented parallel with the direction G along which the grain of the material of the blank 103 extends to increase the strength of the carton 105, as described further herein.

As shown in FIG. 1, the blank 103 has a longitudinal axis L1 and a lateral axis L2. The blank 103 of the illustrated embodiment is formed of a paper-based composite material, for example, paperboard or cardboard, such that a direction G of the grain of the blank 103, e.g., the general direction along which the fibers that constitute the material of the blank 103, is in parallel with the longitudinal axis L1. Since the longitudinal axis L1 extends along the length of the blank 103, and the blank 103 is shown having a length greater than its width, the blank 103 can be considered as formed of a long-grain material. In other embodiments, the direction G of the grain of the blank 103 may be in a direction parallel with the axis L2, and/or the blank 103 may have a width greater than its length.

In the illustrated embodiment, the blank 103 comprises a top panel 112 foldably connected to a first side panel 113 at a lateral fold line 115, a second side panel 117 foldably connected to the top panel at a lateral fold line 119, a bottom panel 121 foldably connected to the second side panel 117 at a lateral fold line 123, and an attachment panel 125 foldably connected to the bottom panel 121 at a lateral fold line 127.

Figure 4:
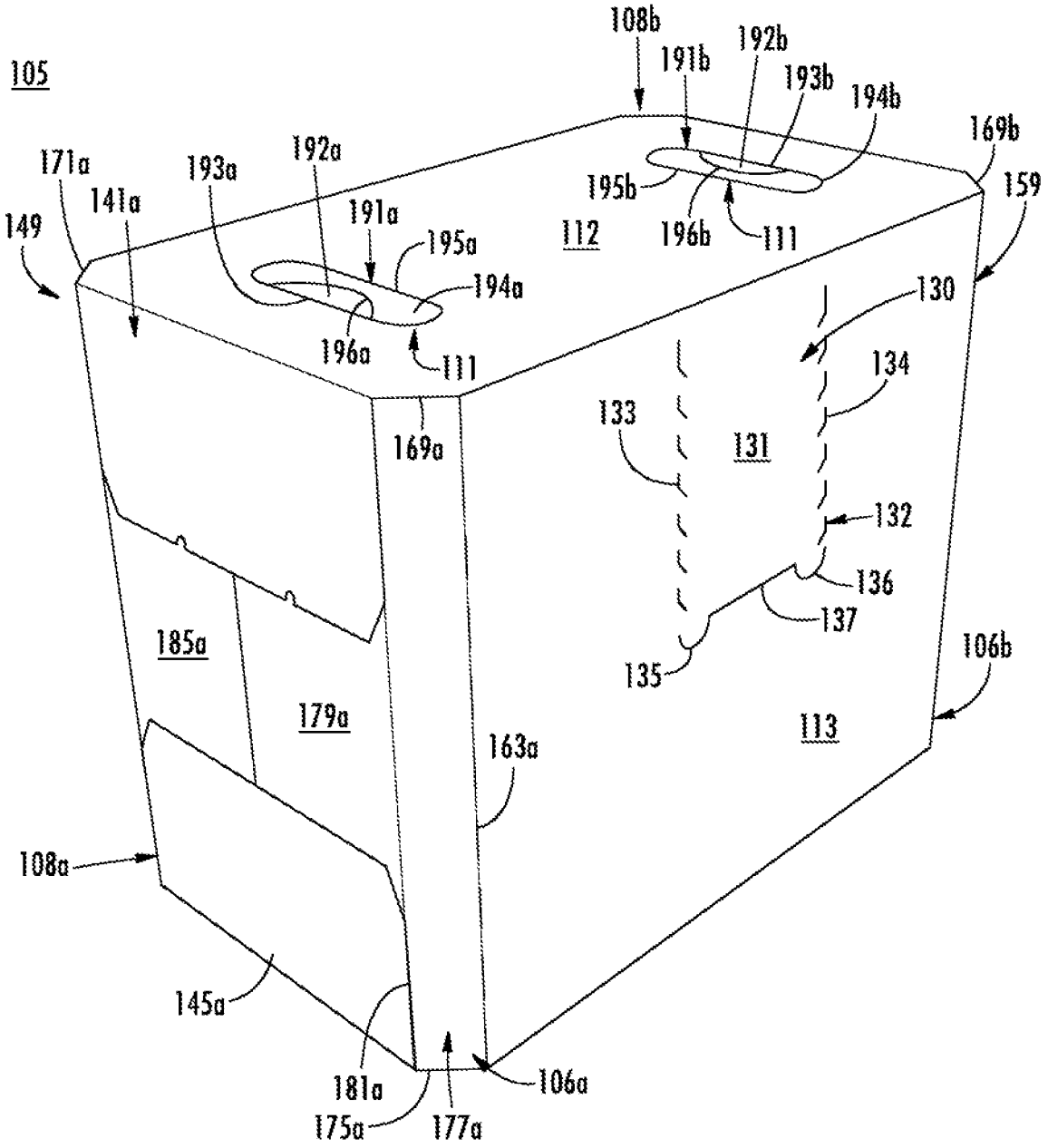
FIG. 4 is a perspective view of a carton formed from the blank of FIG. 1.

As shown, the panels 112, 113, 117, 121 have respective first end flaps 141*a*, 142*a*, 143*a*, 145*a* at a first marginal portion of the blank 103 such that the first end flaps 141*a*, 142*a*, 143*a*, 145*a* are foldably connected to respective panels 112, 113, 117, 121 to close a first end 149 of the carton 105 (FIG. 4). The panels 112, 113, 117, 121 have respective second end flaps 141*b*, 142*b*, 143*b*, 145*b* at a second marginal portion of the blank 103 such that the second end flaps are foldably connected to respective panels 112, 113, 117, 121 to close a second end 159 of the carton 105 (FIG. 4). As shown in FIG. 1, the top end flap 141*a* is foldably connected to the top panel 112 at a longitudinal fold line 161*a*, the side end flap 142*a* is foldably connected to the first side panel 113 at a longitudinal fold line 163*a*, the side end flap 143*a* is foldably connected to the second side panel 117 at a longitudinal fold line 165*a*, and the bottom end flap 145*a* is foldably connected to the bottom panel 121 at a longitudinal fold line 167*a*. The first end flaps 141*a*, 142*a*, 143*a*, 145*a* and the second end flaps 141*b*, 142*b*, 143*b*, 145*b* can be otherwise arranged, shaped, or modified without departing from the scope of the disclosure.

In one embodiment, the top panel 112 includes a first oblique edge 169*a* extending between the fold lines 161*a*, 163*a* and a second oblique edge 171*a* between the fold lines 161*a*, 165*a*. Similarly, the bottom panel 121 includes a first oblique edge 173*a* between the fold lines 165*a*, 167*a* and a second oblique edge 175*a* between the fold line 167*a* and the lateral fold line 127. As shown in FIG. 1, the side end flap 142*a* includes a base portion 177*a* foldably connected to the first side panel 113 at fold line 163*a* and a distal portion 179*a* foldably connected to the base portion 177*a* at a longitudinal fold line 181*a*. The side end flap 143*a* includes a base portion 183*a* foldably connected to the second side panel 117 at the fold line 165*a* and a distal portion 185*a* foldably connected to the base portion 183*a* at a longitudinal fold line 187*a*. In one embodiment, as shown, the blank 103 includes two notches 188*a* in an outer edge 190*a* of the side end flap 141*a*. Additionally, the edges of the top panel 112 and the bottom panel 121 may be arranged, shaped, or modified without departing from the scope of the disclosure. For example, the edges of the top panel 112 and the bottom panel 121 may be curved or orthogonal without departing from the scope of the invention.

As shown in FIG. 1, the second marginal portion of the blank 103 is a mirror image of the first marginal portion so that the second end flaps 141*b*, 142*b*, 143*b*, 145*b* are shaped to have identical features as the first end flaps 141*a*, 142*a*, 143*a*, 145*a*. As such, the second end flaps 141*b*, 142*b*, 143*b*, 145*b* are foldably connected to a respective panel 112, 113, 117, 121 at a respective fold line 161*b*, 163*b*, 165*b*, 167*b*. The top panel 112 has first and second oblique edges 169*b*, 171*b* at the second marginal portion of the blank 103, and the bottom panel 121 has first and second oblique edges 173*b*, 175*b* at the second marginal portion of the blank 103. The side end flap 142*b* at the second marginal portion of the blank 103 has a base portion 177*b* foldably connected to the first side panel 113 at the longitudinal fold line 163*b* and a distal portion 179*b* foldably connected to the base portion 177*b* at a longitudinal fold line 181*b*. The blank 103 includes two notches 188*b* in a peripheral edge 190*b* of the side end flap 141*b*. As shown in FIG. 1, the side end flap 143*b* includes a base portion 183*b* foldably connected to the second side panel 117 at the fold line 165*b* and a distal portion 185*b* foldably connected to the base portion 183*b* at a longitudinal fold line 187*b*. The second end flaps 141*b*, 142*b*, 143*b*, 145*b* and the oblique edges 169*b*, 171*b*, 173*b*, 175*b* could be otherwise shaped, arranged, and/or configured without departing from the disclosure.

In the illustrated embodiment, the first side panel 113 comprises a dispenser 130 having a dispenser panel 131 removably attached to the blank 103 at a tear line, generally indicated at 132. The tear line 132 comprises two longitudinal portions 133, 134 in parallel with at least a portion of respective fold lines 163*a* 163*b* and semicircular portions 135, 136 extending from the edges of the longitudinal portions 133, 134. The tear line 132 comprises a lateral portion 137 extending in the side panel 113 connecting the semicircular portions 135, 136 respectively. As shown, an edge of the dispenser panel 131 opposite the lateral portion 137 may be defined by a portion of the fold line 115 such that the dispenser panel 131 may be hingably separable from the panel 113. The tear line 132 could be otherwise shaped, arranged, and/or configured without departing from the disclosure. For instance, the tear line 132 could be arcuate without departing from the disclosure.

In the illustrated embodiment, the handle features 111 are located in the blank 103 parallel to the grain direction G that is in parallel with the longitudinal axis L1. The handle features 111 include a first handle 191*a* having a first handle flap 192*a* foldably connected to the top panel 112 along a longitudinal fold line 193*a* and a second handle flap 194*a* foldably connected to the top panel 112 along a longitudinal fold line 195*a*. A curved cut 196*a* extends between respective ends of the fold line 193*a* and separates the first handle flap 192*a* and the second handle flap 194*a*. As shown in FIG. 1, the first handle 191*a* includes curved cuts 210*a*, 212*a* extending between respective ends of fold lines 193*a*, 195*a* to define the second handle flap 194*a*. In embodiments, the second handle flap 194*a* may be omitted or alternatively the handle 191*a* may comprise an opening instead of a second handle flap 194*a* without departing from the disclosure.

In the illustrated embodiment, the handle features 111 in the top panel 112 include a second handle 191*b* having similar, mirror-image features as the first handle 191*a*. Accordingly, the second handle 191*b* includes a third handle flap 192*b*, and a fourth handle flap 194*b* separated by a cut 196*b* and foldably connected to the top panel 112 along respective fold lines 193*b*, 195*b*. Curved cuts 210*b*, 212*b* extend between respective ends of the fold lines 193*b*, 195*b*. In embodiments, the fourth handle flap 194*b* may be omitted or alternatively the handle 191*b* may comprise an opening instead of the fourth handle flap 194*b* without departing from the disclosure. As with the first handle 191*a*, the second handle 191*b* is oriented parallel to the grain direction G that is in parallel with the longitudinal axis L1.

In this regard, the first and second handles 191*a*, 191*b* each have a respective major axis M1, M3, e.g., an axis along their longest dimension in the plane defined by the blank 103, extending in parallel with the longitudinal axis L1 and a respective minor axis M2, M4, e.g., an axis along their shortest dimension in the plane defined by the blank 103, extending in parallel with the lateral axis L2 and substantially perpendicular to the respective axis M1, M3. The handle features 111 including one or both of the first and second handles 191*a*, 191*b* can be alternatively arranged without departing from the disclosure. For example, the first handle 191*a* and/or the second handle 191*b* can be oriented 180 degrees such that the fold lines 193*b* and 195*b* are reversed without departing from the spirit of the disclosure. As shown, the fold lines 193*a*, 193*b*, 195*a*, 195*b* of the handles 191*a*, 191*b* are also oriented to be substantially parallel to the grain direction G of the material of the blank 103.

Figure 2:
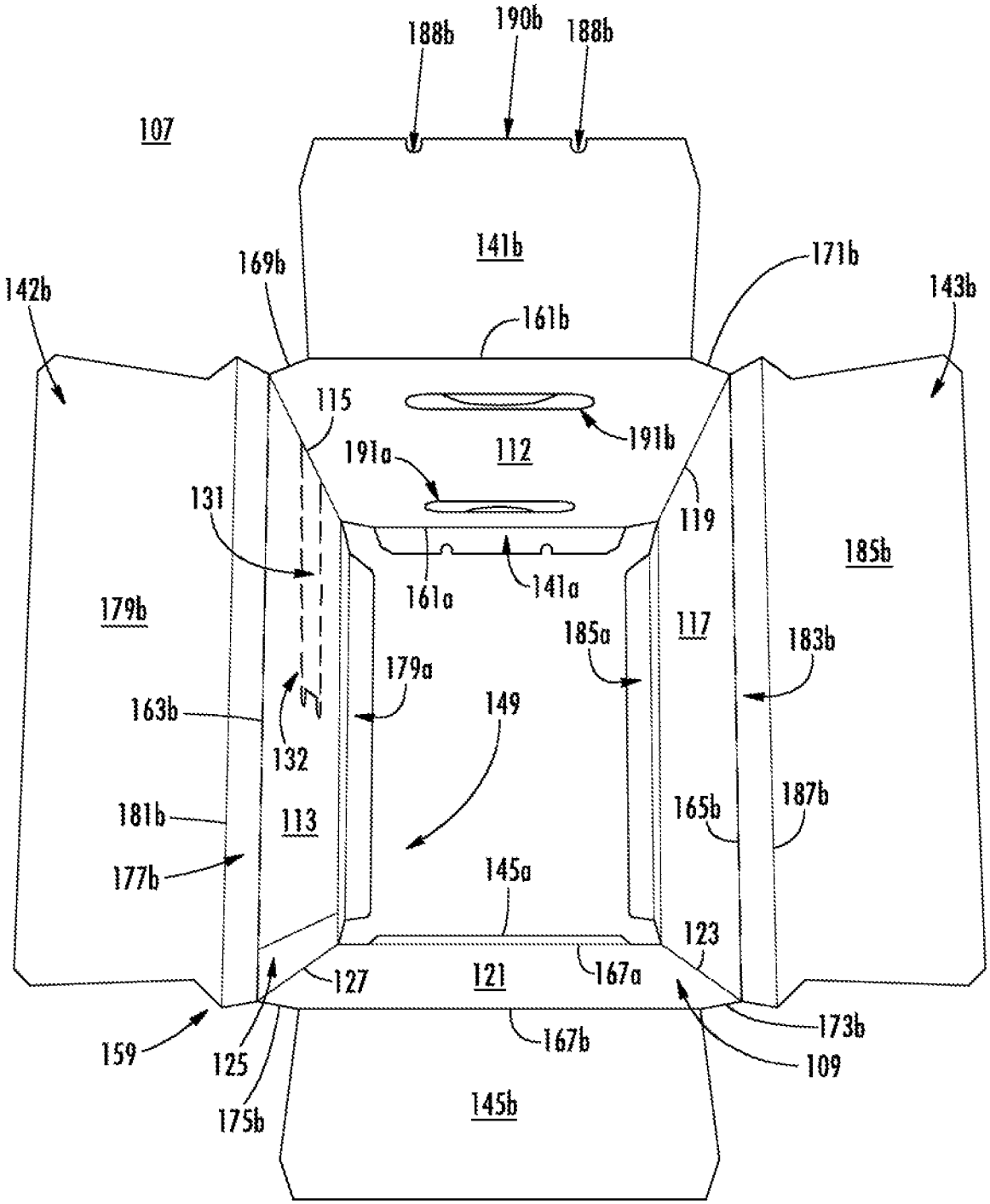
FIG. 2 is a perspective view of a sleeve formed from the blank of FIG. 1.

Referring additionally to FIG. 2, one exemplary method of forming the blank 103 into the carton 105 is illustrated. In the illustrated embodiment, the carton 105 can be formed from the blank 103 by folding the blank 103 along the lateral fold line 119 so that the second side panel 117 overlaps at least a portion of the interior surface of the top panel 112 and first side panel 113, and folding the blank 103 along the lateral fold line 127 so that the attachment panel 125 is in face-to-face contact with the first side panel 113. Alternatively, the blank 103 could be folded along the lateral fold lines 115, 123 so that the first side panel 113 overlaps the attachment panel 125 and the top panel 112. The first side panel 113 can be glued to the attachment panel 125, for example, with an adhesive.

The blank 103 then can be folded along fold lines 115, 119, 123, 127 to form an open-ended sleeve 107, as illustrated, with an interior 109 that will also form the interior 109 of the carton 105 (FIG. 4). Containers or articles can be loaded into the interior of the open-ended sleeve 107 before or after closing either of the ends 149, 159. The blank 103 may be otherwise formed into the open-ended sleeve 107 using alternative folding and gluing steps without departing from the scope of this disclosure.

Figure 3:
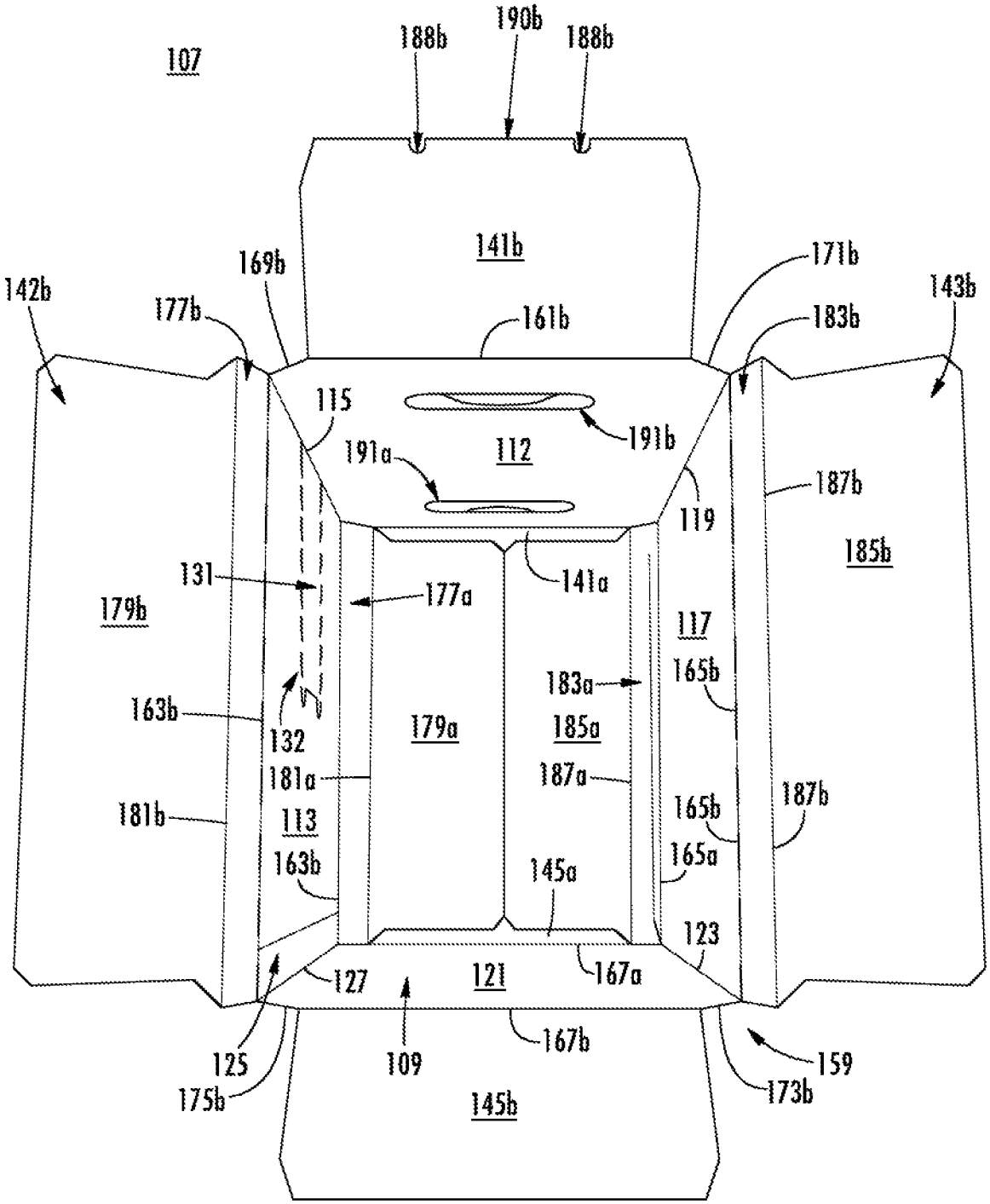
FIG. 3 is a perspective view of the sleeve of FIG. 2 with one end closed.

Referring additionally to FIG. 3, each respective end 149, 159 can be closed by at least partially overlapping and adhering the end flaps 141*a*, 142*a*, 143*a*, 145*a* at one end 149 of the carton 105 and at least partially overlapping and adhering the end flaps 141*b*, 142*b*, 143*b*, 145*b* at the other end 159 of the carton 105. In one embodiment, the top end flap 141*a* and the bottom end flap 145*a* are inwardly folded about respective fold lines 161*a*, 167*a*. As shown, the base portions 177*a*, 183*a* of respective side end flaps 142*a*, 143*a* are angled or positioned to be oblique relative to the side panels 113, 117 with the distal portions 179*a*, 185*a*, positioned to be generally perpendicular to the side panels 113, 117. Further, the base portions 179*a*, 185*a* are adhered in face-to-face contact with the end flaps 141*a*, 145*a*.

Referring additionally to FIG. 4, the end 159 can be closed in a similar manner as described above with respect to end 149 to form the illustrated, closed carton 105. The ends 149, 159 of the carton 105 could be closed by other closing steps and features without departing from the disclosure. In embodiments, the second end 159 of the carton 105 can be closed in a similar manner as the first end 149 by folding, respectively overlapping, and selectively adhering the end flaps 141*b*, 142*b*, 143*b*, 145*b*. One or both of the ends 149, 159 could be otherwise shaped, arranged, configured, or omitted, without departing from the disclosure.

As shown in FIG. 4, the oblique base portions 177*a*, 183*a* of the end flaps 142*a*, 143*a* conform to respective oblique edges 169*a*, 171*a*, 173*a*, 175*a* of the top panel 112 and the bottom panel 121 to form respective angled corners 106*a*, 108*a* at the end 149 of the carton 105 and the oblique base portions 177*b*, 183*b* of the end flaps 142*b*, 143*b* conform to respective oblique edges 169*b*, 171*b*, 173*b*, 175*b* of the top panel 112 and the bottom panel 121 to form respective angled corners 106*b*, 108*b* at the opposite end 159 of the carton 105. In embodiments, angled corners 106*a*, 108*a*, 106*b*, 108*b* may be provided so that indicia or other visual configurations of the exterior of carton 105 may be arranged differently on or near corners 106*a*, 108*a*, 106*b*, 108*b*. Such a configuration may provide a break or disruption in visual perception on the part of the consumer that presents an enhanced opportunity to display indicia disposed on an exterior surface of the carton 105. As another example, when multiple cartons 105 are arranged and/or stacked near each other, the configuration of corners 106*a*, 108*a*, 106*b*, 108*b* may provide a pattern to entice viewing of the surface area of one or more cartons 105 by passersby.

As shown, the dispenser 130 can be used to access the containers or other articles in the carton 105 by tearing along the tear line 132 to partially or fully separate the dispenser panel 131 from the side panel 113 to access the interior 109 (FIG. 2) of the carton 105. In embodiments, the dispenser panel 131 may remain hingably connected to the top panel 112 along a portion of the fold line 115 upon tearing of the tear line 132. The dispenser 130 could have other features, be otherwise arranged, or be omitted without departing from the disclosure.

Figure 5:
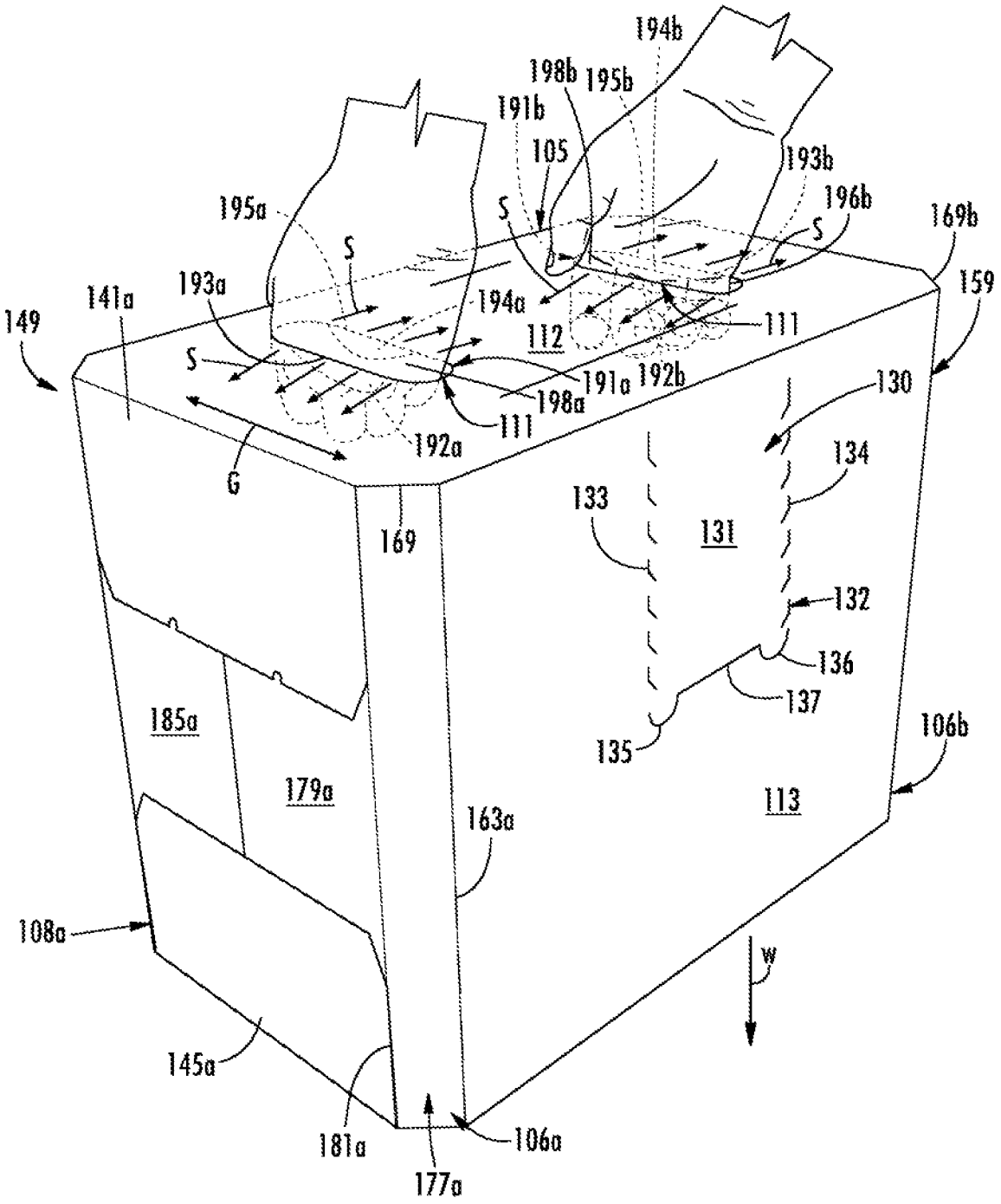
FIG. 5 is a perspective view of the carton of FIG. 4 being lifted by a user.

Referring to FIGS. 1 and 5, one exemplary method of lifting the carton 105 includes folding the handle flaps 194*a*, 194*b* inward along fold lines 195*a*, 195*b* to create respective openings 198*a* 198*b* through which a user may insert a portion of his or her hands or a tool to grasp the carton 105. Additionally or alternatively, the handle flaps 192*a*, 192*b* can be folded inwardly along fold lines 193*a*, 193*b* in conjunction with or separately from the handle flaps 194*a*, 194*b* to create differently-located or widened openings 198*a*, 198*b* without departing from the disclosure. In this regard, the user is presented the flexibility to grasp the carton 105 through manipulation of one or more of handle flaps, 194*a*, 194*b*, 192*a*, 192*b* to provide differently-sized openings 198*a*, 198*b*, for example, to accommodate users with differently-sized hands, or to provide users with options for grasping the carton 105, for example, in a supinate, pronate, or neutral grip, or any intermediate grip. Then the consumer or user can lift the carton 105 using recommended proper lifting technique including but not limited to using two hands, maintaining a natural curve of the back and bending knees to lift the carton.

As described above, the handles 191*a* and 191*b* are uniquely placed with their respective major axes M1, M3 in parallel with the grain direction G of the material (e.g., paperboard, cardboard, or etc.) of the blank 103 that forms the carton 105. This orientation of the handles 191*a*, 191*b* results in stresses S generated in the course of lifting the carton 105 due to the weight W of the carton 105 being distributed generally perpendicular to the grain direction G, as shown. Due to the fibers that constitute the material of the blank 103 that forms the carton 105 being generally oriented in the grain direction G, the material of the blank 103 generally tears more easily along the grain direction G than in the direction parallel to the grain direction G, for example, because the bodies of the fibers must be sheared across in this direction to effect tearing. In this regard, orientation of the major axes M1, M3 of the handles 191*a*, 191*b* in the grain direction G results in tearing stresses S being generated in the direction perpendicular to the grain direction G upon lifting of the carton 105 so that the carton 105 is more resistant to tearing than, for example, a similar carton having similar handles with major axes oriented in a direction other than the grain direction G, for example, perpendicular to the grain direction G. Alternatively, to the embodiment illustrated in FIG. 1, the grain direction G could be rotated 90 degrees (corresponding to the lateral direction L2) and the handles 191*a*, 191*b* could also be rotated 90 degrees (corresponding to the lateral direction L2) without departing from the disclosure.

The carton 105 may be provided with a weight W such that visible tearing of the carton 105 along the top panel 112 near, e.g., radiating from, one or both of handles 191*a*, 191*b* may be resisted at or below a threshold value that is multiple of the weight W during normal use. Such weight W of the carton 105 may include, for example, one or more containers disposed in the interior 109 (FIG. 4) of the carton 105.

In embodiments, the carton 105 may be configured such that the threshold tear resistance may be a value greater than the weight W of the carton 105, for example, 1×W, 2×W, 3×W, 4×W, 5×W, 6×W, 7×W, 8×W, 9×W, 10×, W, 11×W, 12×W, 13×W, 14×W, 15×W, 16×W, 17×W, 18×W, 19×W, 20×W, or values therebetween.

The carton 105 is thus provided herein with an enhanced tear resistance such that a material of the blank 103 (FIG. 1) can be selected, for example, as a lower caliper board as compared to a similar carton having similar handles with major axes oriented in a direction other than the grain direction G. Such ability to produce a lower caliper board can for example, reduce costs in producing the carton 105 and reduce environmental impacts associated with the production of the carton 105. The handles 191*a*, 191*b* could have other features or be otherwise positioned without departing from the disclosure.

Figure 6:
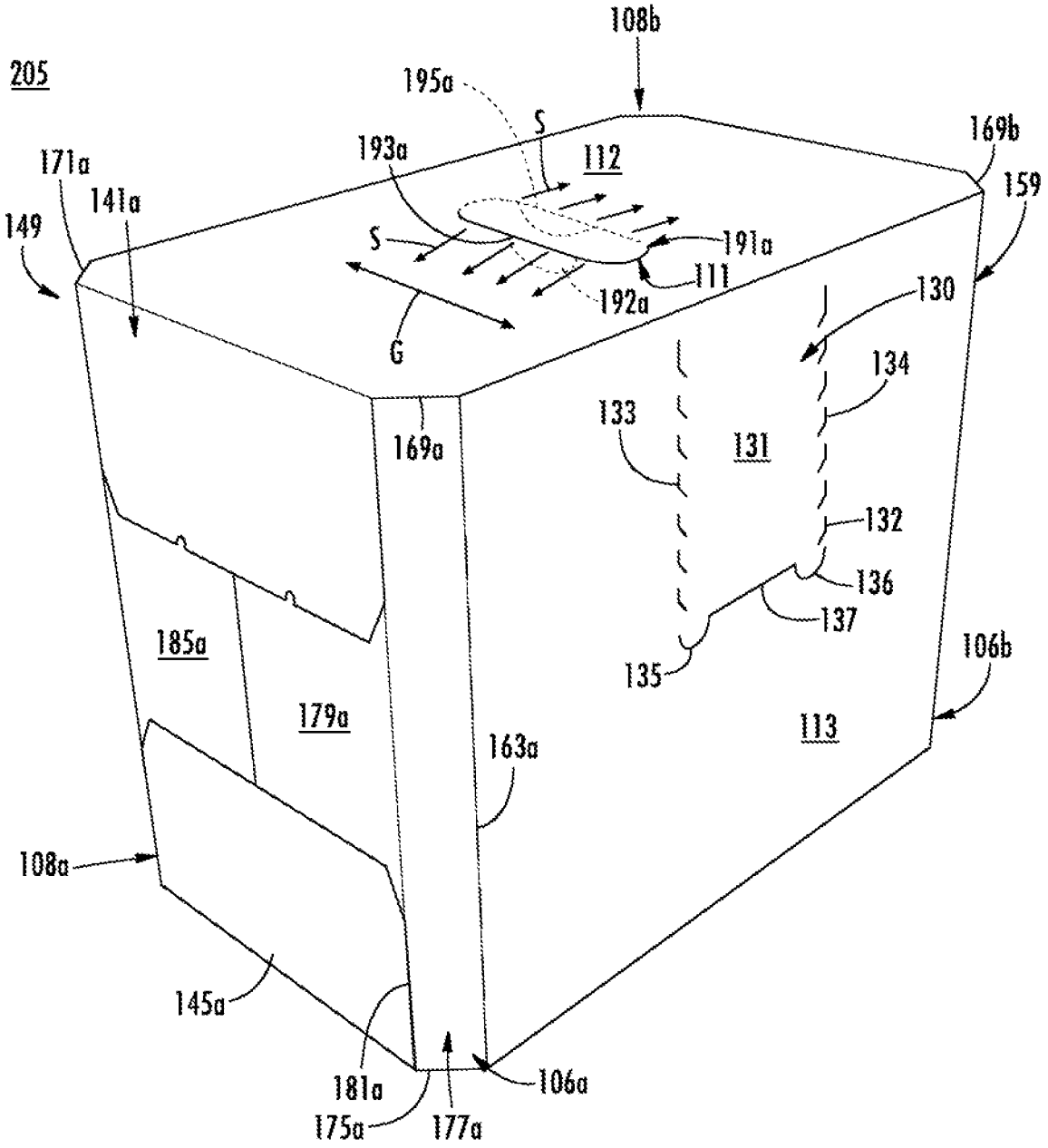
FIG. 6 is a perspective view of a carton according to another exemplary embodiment of the disclosure.

For example, and with reference to FIG. 6, a carton 205 according to an exemplary embodiment of the disclosure may be provided. Carton 205 may have substantially similar features to carton 105 described above, but with have a single handle, e.g., handle 191*a* as shown, positioned along the top panel 112 with the major axis M1 (FIG. 1) oriented in parallel with the grain direction G of the carton 205 such that tearing stresses S generated in the course of lifting the carton 205 (lifting not shown) are generated in the direction perpendicular to the grain direction so that the carton 205 is more resistant to tearing than, for example, a similar carton having a similar handle with a major axis oriented in a direction other than the grain direction G, for example, perpendicular to the grain direction G. The single handle 191*a* may be centrally positioned along the top panel 112, as shown, or may have a different placement. Carton 205 may be used in a similar manner as carton 105 described above, with the single handle 191*a* providing access to a user for grasping the carton 205. In embodiments, cartons may be provided with additional handles.

In general, the blanks described herein may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for carrying a plurality of articles, comprising:

a plurality of panels for at least partially forming an interior of the carton, the plurality of panels comprising a top panel, a bottom panel, and at least one side panel, the plurality of panels comprise a material having a grain direction;

a plurality of end flaps foldably connected to a respective panel of the plurality of panels and forming at least one closed end of the carton; and a first handle and a second handle formed in the top panel, the first handle comprising a first handle opening arranged to receive a first hand of a user and the second handle comprising a second handle opening arranged to receive a second hand of the user, each of the first handle and the second handle defining a respective major axis that is substantially parallel to the grain direction; and a dispenser, the dispenser comprising a dispenser panel separable from the at least one side panel to access an interior of the carton, the first handle opening positioned a first distance from the at least one end of the carton, the dispenser panel positioned a second distance from the at least one closed end of the carton, and the second handle opening positioned a third distance from the at least one closed end of the carton, the third distance is greater than the second distance, and the second distance is greater than the first distance.

2. The carton of claim 1, wherein each of the first handle and the second handle defines a respective minor axis that is substantially perpendicular to the respective major axis.

3. The carton of claim 2, wherein the grain direction extends in a longitudinal direction and a lateral direction is perpendicular to the longitudinal direction.

4. The carton of claim 1, wherein the first handle comprises a first flap foldably connected to the top panel for forming the first handle opening, and the second handle comprises a second flap foldably connected to the top panel for forming the second handle opening.

5. The carton of claim 1, wherein the grain direction is a direction in which a plurality of fibers of the material of the plurality of panels are generally oriented.

6. The carton of claim 1, wherein the material of the plurality of panels is paperboard.

7. The carton of claim 1, wherein the plurality of end flaps is a first plurality of end flaps foldably connected to a respective panel of the plurality of panels and the at least one closed end of the carton is a first closed end of the carton formed by the first plurality of end flaps, and the carton further comprises a second plurality of end flaps foldably connected to a respective panel of the plurality of panels to form a second closed end of the carton.

8. The carton of claim 7, wherein the first handle is adjacent the first closed end and the second handle is adjacent the second closed end.

9. The carton of claim 1, wherein the first handle and the second handle are oriented such that, upon lifting of the carton at the first handle and the second handle, stresses are distributed generally perpendicular to the grain direction.

10. The carton of claim 1, wherein at least one angled corner is formed between the at least one side panel and the at least one closed end of the carton.

11. The carton of claim 1, wherein the top panel is a single top panel of the plurality of panels that defines a top of the carton.

12. The carton of claim 1, wherein the first handle and second handle being positioned for lifting the carton by activation of both the first handle and the second handle by the respective first hand and the second hand of the user.

13. The carton of claim 1, wherein the at least one closed end defines a plane, and the first distance, the second distance, and the third distance are all along a direction perpendicular to the plane.

14. A blank for forming carton for carrying a plurality of articles, comprising:

a plurality of panels for at least partially forming an interior of the carton formed from the blank, the plurality of panels comprising a top panel, a bottom panel, and at least one side panel, the plurality of panels comprise a material having a grain direction;

a plurality of end flaps foldably connected to a respective panel of the plurality of panels for forming at least one closed end of the carton formed from the blank; and a first handle and a second handle formed in the top panel, the first handle comprising a first handle opening arranged to receive a first hand of a user in the carton formed from the blank and the second handle comprising a second handle opening arranged to receive a second hand of the user in the carton formed from the blank, each of the first handle and the second handle defining a respective major axis that is substantially parallel to the grain direction; and a dispenser comprising a dispenser panel separable from the at least one side panel to access an interior of the carton formed from the blank, the first handle for being positioned a first distance from the at least one end of the carton formed from the blank, the dispenser panel for being positioned a second distance from the at least one closed end of the carton formed from the blank, and the second handle positioned a third distance from the at least one closed end of the carton formed from the blank, the third distance is greater than the second distance, and the second distance is greater than the first distance.

15. The blank of claim 14, wherein each of the first handle and the second handle defines a respective minor axis that is substantially perpendicular to the respective major axis.

16. The blank of claim 15, wherein the grain direction extends in a longitudinal direction and a lateral direction is perpendicular to the longitudinal direction.

17. The blank of claim 14, wherein the first handle comprises a first flap foldably connected to the top panel for forming the first handle opening in the carton formed from the blank, and the second handle comprises a second flap foldably connected to the top panel for forming the second handle opening in the carton formed from the blank.

18. The blank of claim 14, wherein the grain direction is a direction in which a plurality of fibers of the material of the plurality of panels are generally oriented.

19. The blank of claim 14, wherein the material of the plurality of panels is paperboard.

20. The blank of claim 14, wherein the plurality of end flaps is a first plurality of end flaps foldably connected to a respective panel of the plurality of panels and the at least one closed end is a first closed end formed by the first plurality of end flaps in the carton formed from the blank, and the blank further comprises a second plurality of end flaps foldably connected to a respective panel of the plurality of panels to form a second closed end of the carton formed from the blank.

21. The blank of claim 20, wherein the first handle is arranged for being adjacent the first closed end of the carton formed from the blank and the second handle is arranged for being adjacent the second closed end of the carton formed from the blank.

22. The blank of claim 14, wherein the first handle and the second handle are oriented such that, upon lifting of the carton formed from the blank at the first handle and the second, stresses are distributed across the carton formed from the blank generally perpendicular to the grain direction.

23. The blank of claim 14, wherein at least one angled corner is formed between the at least one side panel and the at least one closed end of the carton formed from the blank.

24. The blank of claim 14, wherein the top panel is a single top panel of the plurality of panels that is for defining a top of the carton formed from the blank.

25. The blank of claim 14, wherein the at least one closed end of the carton formed from the blank defines a plane, and the first distance, the second distance, and the third distance are along a direction perpendicular to the plane.

26. A method of forming a carton for carrying a plurality of articles, comprising:

obtaining a blank comprising a plurality of panels comprising a top panel, a bottom panel, and at least one side panel, the plurality of panels comprising a material having a grain direction, a first handle formed in the top panel and comprising a first handle opening, and a second handle formed in the top panel and comprising a second handle opening, each of the first handle and the second handle defining a respective major axis that is substantially parallel to the grain direction, a plurality of end flaps foldably connected to a respective panel of the plurality of panels, and a dispenser comprising a dispenser panel separable from the at least one side panel; and folding the plurality of panels to at least partially form an interior of the carton and folding the plurality of end flaps to form at least one closed end of the carton such that the first handle opening is arranged to receive a first hand of a user and the second handle opening is arranged to receive a second hand of the user, the first handle opening positioned a first distance from the at least one end of the carton, the dispenser panel positioned a second distance from the at least one closed end of the carton, and the second handle opening positioned a third distance from the at least one closed end of the carton, the third distance is greater than the second distance, and the second distance is greater than the first distance.

27. The method of claim 26, wherein each of the first handle and the second handle defines a respective minor axis that is substantially perpendicular to the respective major axis.

28. The method of claim 27, wherein the grain direction extends in a longitudinal direction and a lateral direction is perpendicular to the longitudinal direction.

29. The method of claim 26, wherein the first handle comprises a first flap foldably connected to the top panel for forming the first handle opening and the second handle comprises a second flap foldably connected to the top panel for forming the second handle opening.

30. The method of claim 26, wherein the grain direction is a direction in which a plurality of fibers of the material of the plurality of panels are generally oriented.

31. The method of claim 26, wherein the material of the plurality of panels is paperboard.

32. The method of claim 26, wherein the plurality of end flaps is a first plurality of end flaps foldably connected to a respective panel of the plurality of panels and the at least one closed end of the carton is a first closed end of the carton formed from the first plurality of end flaps when the plurality of panels are folded, and the blank further comprises a second plurality of end flaps foldably connected to a respective panel of the plurality of panels to form a second closed end of the carton when the plurality of panels are folded.

33. The method of claim 32, wherein the first handle is adjacent the first closed end of the carton and the second handle is adjacent the second closed end of the carton when the plurality of panels are folded.

34. The method of claim 26, further comprising separating the dispenser panel from the at least one side panel to provide access to the interior of the carton.

35. The method of claim 26, wherein the at least one handle is oriented such that, upon lifting of the carton at the first handle and the second handle when the plurality of panels are folded, stresses are distributed across the carton formed from the blank generally perpendicular to the grain direction.

36. The method of claim 26, wherein at least one angled corner is formed between the at least one side panel and the at least one closed end of the carton when the plurality of panels are folded.

37. The method of claim 26, wherein the top panel is a single top panel of the plurality of panels that defines a top of the carton.

38. The method of claim 26, further comprising lifting the carton by activating the first handle and the second handle and simultaneously lifting the carton at the first handle with the first hand of the user and at the second handle with the second hand of the user.

39. The method of claim 26, wherein the at least one closed end defines a plane, and the first distance, the second distance, and the third distance are all along a direction perpendicular to the plane.

* * * * *